United States Patent [19]

Belli

[11] 4,226,422

[45] Oct. 7, 1980

[54] FLYING SAUCER SIMULATION GAME

[76] Inventor: John A. Belli, 75 Elizabeth St., Fitchburg, Mass. 01420

[21] Appl. No.: 924,134

[22] Filed: Jul. 13, 1978

[51] Int. Cl.[3] ..... A63F 9/00

[52] U.S. Cl. ..... 273/368; 273/413

[58] Field of Search ..... 273/95 B, 95 A, 105.2, 273/101, 368, 413; 46/269, 61, 62, 63, 67, 70

[56] References Cited

U.S. PATENT DOCUMENTS

| | | | |
|---|---|---|---|
| 722,070 | 3/1903 | Zimmerman | 46/67 |
| 1,794,314 | 2/1931 | Mueller | 46/67 |
| 3,082,574 | 3/1963 | Hellman | 46/269 |
| 3,422,568 | 1/1969 | Vorves | 46/269 |
| 3,545,126 | 12/1970 | Brown | 46/269 |
| 3,858,348 | 1/1975 | Brown | 46/61 |
| 4,093,231 | 6/1978 | Gleason | 273/108 |
| 4,100,697 | 7/1978 | Ward | 46/269 |

FOREIGN PATENT DOCUMENTS

| | | | |
|---|---|---|---|
| 648574 | 1/1951 | United Kingdom | 273/95 A |

*Primary Examiner*—Anton O. Oechsle

*Attorney, Agent, or Firm*—Schiller & Pandiscio

[57] ABSTRACT

A novel type of game device is disclosed wherein the device comprises a controllable object adapted for movement relative to a rotating turntable which has a topographically-varying upper surface. The game device is intended to provide amusement and challenge for one or more players who alternately guide the controllable object relative to the turntable in such a way as to attempt certain pre-determined objectives. The object is suspended over the turntable by a string capable of winding on itself when one end thereof is rotated about its center axis. The object is controlled by selectively rotating the string fast enough in one direction and the other to cause the object to be selectively raised and lowered.

11 Claims, 4 Drawing Figures

FLYING SAUCER SIMULATION GAME

This invention relates to amusement devices or games in general, and more particularly to a novel game of skill requiring each player to pilot a controllable object in an effort to achieve certain predetermined objectives.

One of the objects of this invention is to provide an entertaining and amusing game.

Another object is to provide an interesting game combining player skill with the element of chance.

Yet another object is to provide a game which allows a player to pilot an object using electrical and mechanical control means.

Still another object is to provide a game which can be used by one or more players.

A further object is to provide a game which can easily be adapted to represent a flying saucer being manuevered over a planet or asteroid.

These and other objects of the present invention are addressed by providing a novel type of game comprising a controllable object adapted for movement relative to a rotating, topographically-varying turntable wherein one or more players alternately pilot the controllable object relative to the turntable so as to attempt certain predetermined objectives.

Other objects and advantages of the present invention will be evident from the following detailed description, which is to be considered together with the accompanying drawings wherein.

DESCRIPTION OF THE PREFERRED EMBODIMENT

Figure 1:
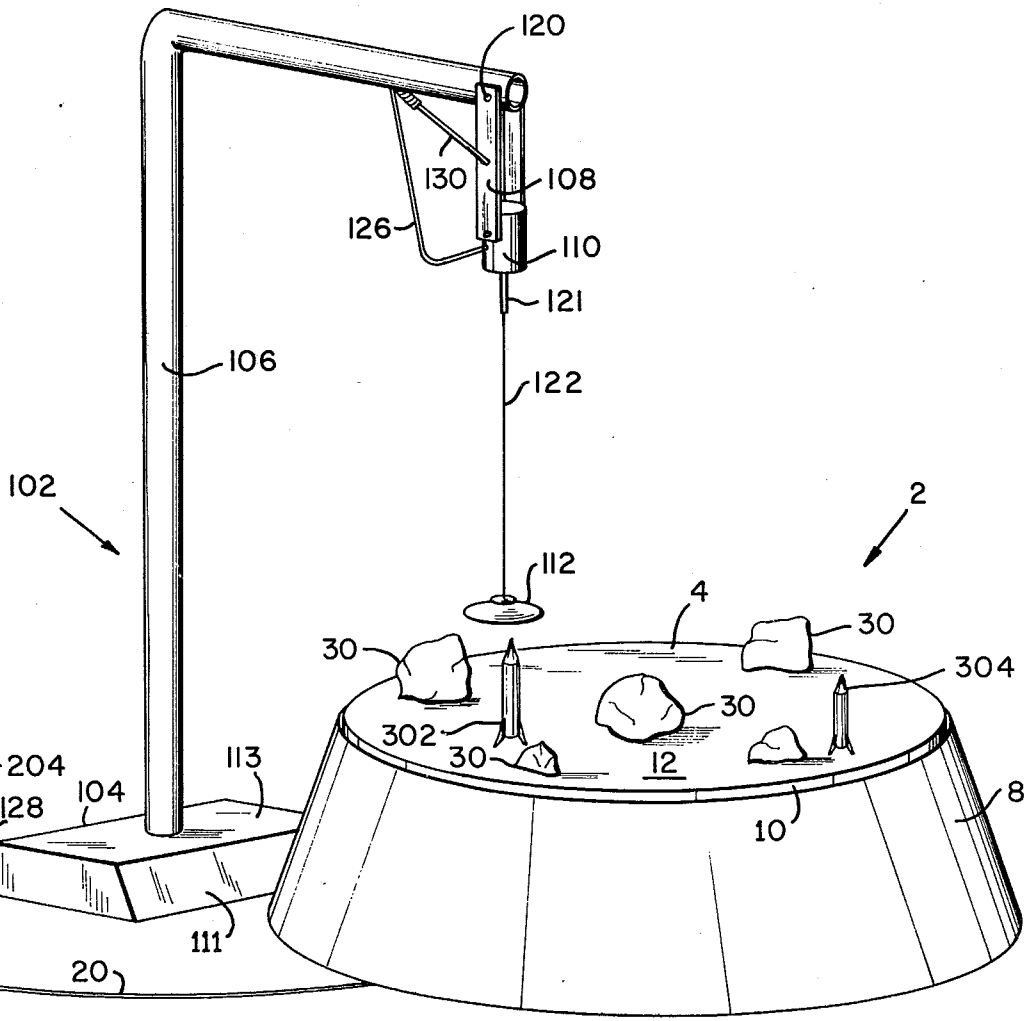
FIG. 1 is a view in perspective showing the preferred embodiment of the present invention.
Figure 2:
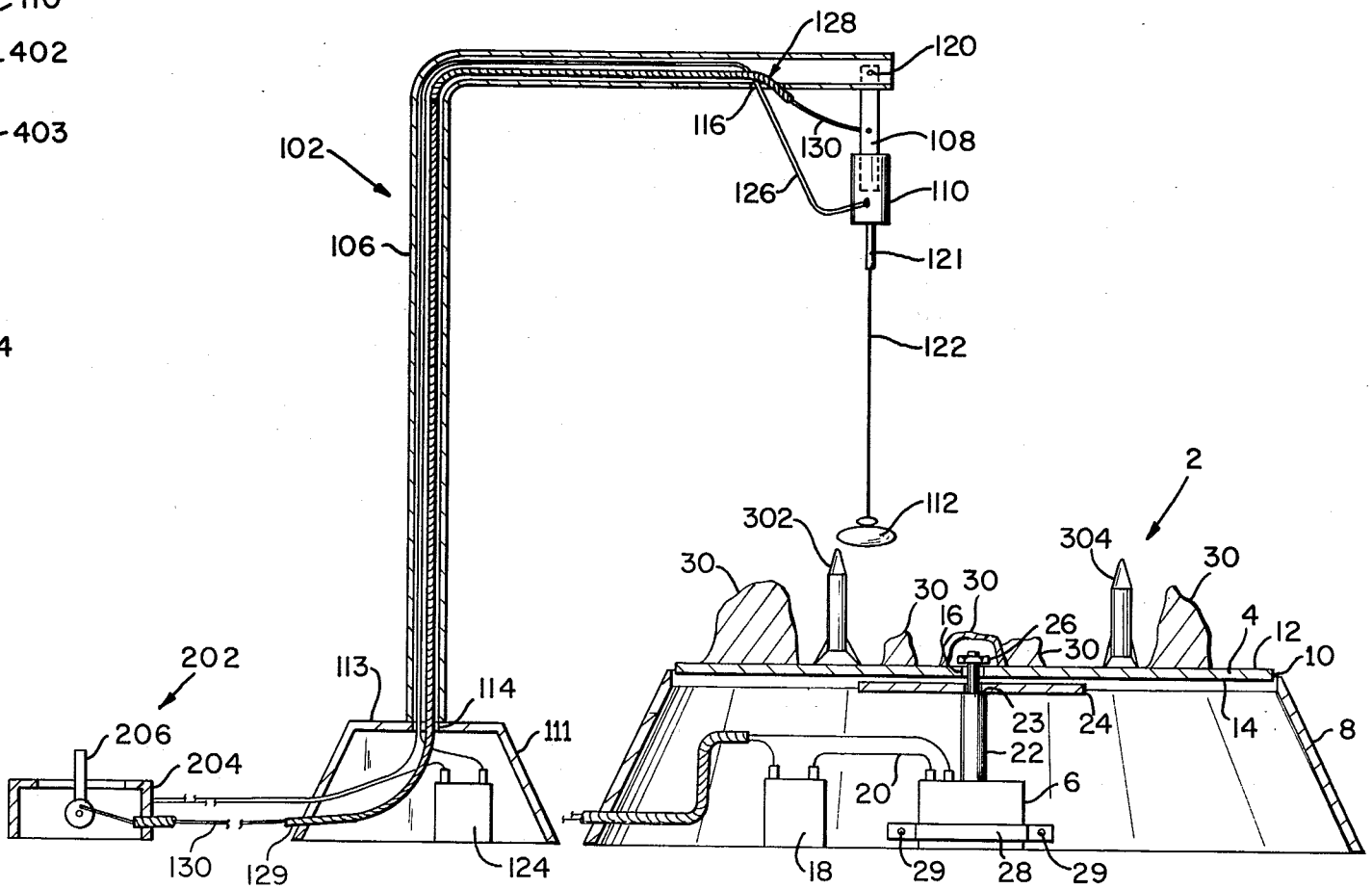
FIG. 2 is a sectional view of the same embodiment.

Looking first to FIGS. 1 and 2, we see the preferred form of the present invention. It generally comprises a turntable assembly 2, a support assembly 102 and a control assembly 202.

The turnable assembly 2 comprises a platter member 4, a drive motor 6 and a frusto-conical skirt 8. Platter member 4 is characterized by a cylindrical outer surface 10, a flat upper surface 12, a flat lower surface 14 and a central bore 16. Drive motor 6 is adapted to run on electric power supplied by power source 18 via wires 20, and to turn a vertical power shaft 22. Shaft 22 has an outside diameter slightly smaller than the inside diameter of central bore 16 at its top and is enlarged to provide a shoulder 23 further down its shaft. A flange 24 is fixed to shoulder 23. Platter member 4 is disposed on shaft 22 so that the top portion of the shaft passes through central bore 16 until the flat bottom surface 14 of platter 4 seats upon flange 24. Platter 4 is firmly secured to flange 24 by an nut 26 screwed on the upper end of shaft 22, so that any rotation of power shaft 22 is directly transmitted to platter 4. In this manner, drive motor 6 is used to rotate platter 4. Motor 6 is adapted to rotate platter 4 at a suitable speed, e.g. 10 r.p.m. Surrounding platter 4, power source 18 and drive motor 6 is a frusto-conical skirt 8. Drive motor 6 is attached to skirt 8 via straps 28 and screws 29 which are received by holes in the skirt. Skirt 8 is sized so as to have a smaller top opening than bottom opening, and the top opening is sized and positioned to form a near fit with the cylindrical outer surface 10 of platter 4. Skirt 8 effectively conceals power source 18, drive motor 6 and all but the top surface 12 of platter 4.

In the preferred embodiment platter assembly 2 is intended to represent the topographically-varying surface of a planet or asteroid. For this purpose, a plurality of forms 30 are mounted to the flat top surface 12 of platter 4 so as to provide elevated terrain features. Forms 30 may be hill contours, buildings, crater rims or other objects which might be found on a planet or asteroid surface, and are preferably painted to enhance the desired visual effects. The exterior side of skirt 8 may be decorated in a similar manner.

Positioned near platter assembly 2 is the support assembly 102. It comprises a rectangular base 104, a hollow support arm 106, directing rods 108, an elevation motor 110 and a saucer-shaped object 112 (hereinafter referred to as saucer 112). Base 104 may be formed of four sides 111 and a top surface 113 so as to define an interior enclosure, and is provided with a hole 114 centrally located in its top surface 113 which communicates with the interior of hollow arm 106. Hollow support arm 106 is formed with open ends and has 90° bend in its length so as to have an essentially L-shaped configuration. The bottom end of arm 106 is mounted to the top surface of base 104 so that bore 114 lies within the perimeter of tube 106 and the interior hollow of arm 106 is joined with the interior hollow of base 104. The upper horizontal end of arm 106 is provided with a vertical hole 116 near its end.

Directing rods 108 comprise two identical members passing on either side of support arm 106. The upper sections of rods 108 are pivotally attached to support arm 106 by a pivot pin 120. An elevation motor 110 is in turn pivotally mounted between the bottom sections of directing rods 108, and a saucer 112 is suspended from the shaft 121 thereof by means of a string 122. Saucer 112 is symmetrical in plan view, i.e. about the axis of string 122.

Electric power for elevation motor 110 may be provided by a power source 124 via wires 126. Source 124 is preferably contained within base 104 and wires 126 routed through bore 114, up the interior of support arm 106 and out bore 116 to the motor. In this manner, elevation motor 110 can be suitably energized to cause shaft 121 to rotate, in turn causing string 122 and saucer 112 to rotate. String 122 is attached suitably close to the shaft's center of rotation as to allow the string to hang substantially straight during rotation. At a suitably high speed of rotation of the motor shaft 121, e.g. 800 r.p.m., the saucer's inertia will cause it to spin substantially slower than shaft 121 and string 122 will begin to knot and wind on itself. This in turn causes the string 122 to shorten, raising saucer 112 relative to surface 12 and imparting a gyroscopic rotation of it. By turning off motor 110, string 122 is allowed to gradually unwind itself and saucer 112 slowly returns to its original position. By reversing motor 110 while saucer 112 is in a raised position, string 112 will be quickly unwound and saucer 112 rapidly lowered. In this manner saucer 112 can be moved vertically relative to platter assembly 2.

Saucer 112 is moved radially relative to platter 4 via directing rods 108 and a sheathed cable 128 comprising a sheath 129 and a wire 130 slidably disposed in sheath 129. Sheathed cable 128 extends up through support arm 106 and out bore 116, and wire 130 is attached to at least one of the directing rods 108 at a point which is preferably close to motor 110. By pushing and pulling on wire 130 so that it slides in sheath 129, rods 108 can be made to rotate on their pivots and thereby cause saucer 112 to move radially above platter 4. In the preferred embodiment, saucer 112 is meant to represent a flying saucer apparatus and is suitably decorated to achieve this function.

Support assembly 102 is positioned near to platter assembly 2 in such a way that when the directing rods 108 sit perfectly vertical, the center of saucer 112 falls directly over the center of a radius of platter 4. In addition, the length of directing rods 108 is related to the size of platter 4 in such a manner that by moving rods 108 on their pivots, an entire radius of the platter can be traversed by the saucer 112. It will then be seen that by suitably moving directing rods 108 while motor 6 is rotating platter 4, saucer 112 can be directed over any point on the surface of platter 4. Simultaneously, one may operate elevation motor 110 so as to vary the height of saucer 112 relative to the platter.

A control assembly 202 is provided to facilitate simultaneous control of turntable assembly 2 and support assembly 102. It comprises a housing 204 mounting a lever assembly 206, an on-off switch 208 and a three-position switch 212. Lever 206 is pivotally mounted to housind 204 and is coupled to the end of wire 130. The sheath 129 of cable 128 is fixed to housing 204, whereby movement of lever 206 serves to move wire 130 and thereby urge directing rods 108 to move about their pivot.

Figure 3A:
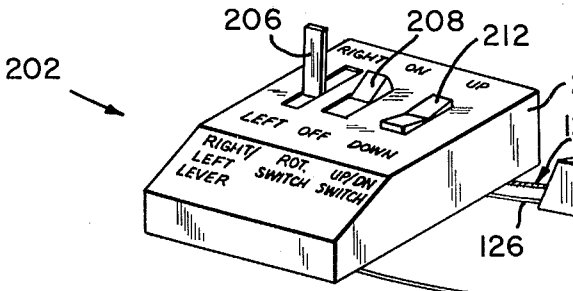
FIGS. 3A and 3B are circuit diagrams.
Figure 3A:
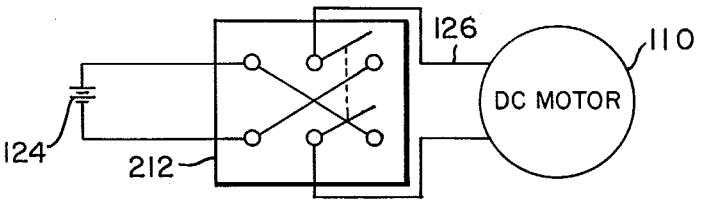
Figure 3B:
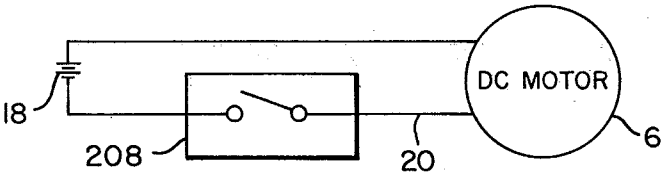

As shown in the circuit diagrams of FIGS. 3A and 3B, switch 208 is coupled to power supply 18 and motor 6 and serves to turn motor 6 on or off, and switch 212 is coupled to power supply 124 and motor 110 and functions as an on-off switch and a reversing switch. Thus, switch 212 can be operated so as to (1) cause shaft 121 to rotate clockwise, (2) maintain shaft 121 stationary, or (3) cause shaft 121 to rotate counter-clockwise. In this manner, by using the controls mounted on control assembly 202, it is possible to direct saucer 112 over any point on the surface of platter 4 and vary its height relative to that surface. It is to be noted that while motors 6 and 110 are shown in FIG. 3 to be DC motors and power supplies 18 and 124 to be DC batteries, suitable AC apparatus may be substituted.

The aforementioned apparatus is intended to be utilized as a game in the following manner. First, a plurality of targets 302 are positioned on designated spots on the top of platter 4. Targets 302 may be shaped like missiles and are painted a first color. Next, a plurality of penalty units 304 may be positioned on designated spots on the top of platter 4. It is preferred that these also be shaped as missiles and painted a second color.

At this point all switches are off and the saucer is at rest on platter surface 12. Each player is then given a specified time at the controls, i.e. lever 206, switch 208 and switch 212, during which he attempts to pilot the saucer so as to collide with and knock over targets 302 without running into penalty units 302 or terrain features 30. Each target 302 knocked over yields a certain number of positive points and each penalty unit 304 knocked over a certain number of negative points. Winner is the player who has the highest score after everyone has taken a turn at the controls.

It should be noted that the preferred embodiments illustrated and described herein are intended solely for the sake of example and clarity and are to be in no way construed as limiting the scope of the present invention, since various alterations may be carried out on the illustrated embodiments without departing from the essential features of the invention. Thus, for example, support arm 106 may be formed with an arcing curve along its length rather than the abrupt 90° elbow shown in FIGS. 1 and 2, or the arm might be formed with a square or rectangular cross-section rather than the round one disclosed.

Another contemplated modification relates to the pivoting mount securing directing rods 108 to support arm 106. Instead of a pair of rods 108 passing on either side of arm 106, arm 106 could be provided with a slit in its end to accommodate a single rod 108 and a single pin may be used to pivotally mount rod 108 to arm 106. Motor 110 could then be mounted to the single rod 108. Another modification would be to provide saucer 112 with a plurality of slits to produce a whirling sound as it rotates, thus adding audio effect to the game. Still another modification would be to enclose the horizontal section of shaft 106, directing rods 108, and motor 110 in a hollow object resembling a large space ship.

Yet another contemplated modification would be to combine power sources 124 and 18 into one unit, or to form platter 4 with terrain features 30 as part of its upper surface 12. Still another modification would be to form support arm base 104 as part of turntable assembly skirt 8.

Figure 4:
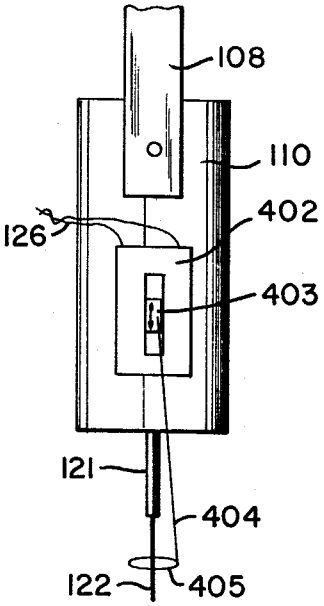
FIG. 4 is a contemplated modification of the elevation motor.

Another modification is shown in FIG. 4. It comprises a safety switch arrangement for the elevation motor 110 and is designed to prevent saucer 112 from climbing up too high on string 122 so as to strike shaft 121. Motor 110 is provided with a safety switch 402 with an actuating member 403 to which is coupled a stiff wire loop assembly 404. Switch 402 is operated by moving its activator 403 vertically. Loop assembly 404 extends from the activator switch 402 downward along string 122 and at its end has a horizontal loop 405 encircling the string. In its down position, activator 403 turns motor 110 on. In its up position, activator 403 turns motor 110 off. Activator 403 is normally seated in the down or "on" position, but should a saucer rise too high it will contact wire loop assembly 404 and force it upwards, moving activator 403 to the "off" position. In this manner, safety switch 402 prevents a saucer from climbing too high on its string.

Still another contemplated moidification is to substitute a spring driven motor for electric motor 6. The length of each player's turn may then be defined as lasting as long as motor 6 runs. This modification allows the combination of increased suspense due to the imprecise time of each turn as delivered by a spring and decreased cost to the substitution of a less-expensive component. Or the game might utilize rubbercoated electrical switches and suitable related members in place of targets 302 or penalty units 304 so that simply contacting the members 302 or 304 with saucer 112 would set off a counter or buzzer apparatus. In this manner it would not be necessary to actually knock over members 302 or 304 with the saucer.

It is also possible to modify the manner in which the aforementioned apparatus is utilized. Thus, for example, one might set up targets 302 and/or penalty units 304 in clusters to simulate bases and use a randomizer, such as a spinner apparatus, to select which bases are to be attacked.

These and other changes of their type are foreseen as readily obvious to one skilled in the art.

What is claimed is:

1. A game device comprising:

(1) a turntable assembly comprising (a) a platter having a top surface and an outer rim and (b) a first motor assembly for rotating said platter;

(2) a support arm assembly comprising a support member, a second motor assembly having a drive shaft, means attaching said second motor assembly to said support member so that said drive shaft extends downward from said second motor assembly and so that said second motor assembly can be moved laterally, a symmetrical object, and a string attached at one end to said object and at the other end to said drive shaft, said second motor assembly being capable of driving said drive shaft sufficiently fast to cause said string to wind on itself and raise said object relative to the top surface of said turntable;

(3) control means for energizing said first and second motor assemblies and for moving said second motor assembly laterally over said platter; and (4) a plurality of longitudinally objects standing on said top surface of said platter, whereby said objects are capable of being struck by said cross-sectionally symmetrical object.

2. A game according to claim 1 further including a skirt assembly surrounding said platter, said skirt assembly being frusto-conical in shape and having a top opening surrounding and making a close fit with said outer rim of said platter.

3. A game according to claim 1 wherein said top surface of said platter is topographically-varying.

4. A game according to claim 1 wherein said string is attached to the top of said symmetrical object.

5. A game according to claim 1 wherein said symmetrical object is saucer-shaped.

6. A game according to claim 1 wherein said support arm assembly is positioned to said turnable assembly so that said second motor assembly can be moved radially over said platter.

7. A game according to claim 1 wherein said support member comprises a first vertical section, a second horizontal section and a third section, with said second section being rigidly mounted to said first section and said third being pivotally mounted to said second section, and further wherein said second motor assembly is pivotally mounted to said third section.

8. A game according to claim 7 wherein said control means comprises a lever assembly and a cable connecting said third section with said lever assembly, said lever assembly and cable being adapted to urge said third section to move on its pivot relative to said second section.

9. A game device comprising:

(a) a support assembly comprising a support member, a reversible motor having a drive shaft, means for attaching said motor to said support member, a symmetrical object, and a string capable of winding on itself when one end thereof is rotated about its center axis, one of said string being attached to said object, the other end of said string being attached coaxially to said drive shaft, said motor being adapted to rotate said drive shaft fast enough to cause said string to wind on itself and raise said object vertically toward said motor when said motor is energized while oriented so that said drive shaft extends vertically downward toward said object; and (b) means for selectively energizing said motor, said means including switch means for energizing said reversible motor so as to cause said reversible motor to rotate said shaft in one direction or the other.

10. A game according to claim 9 wherein said support member is adapted to movably support said motor.

11. A game according to claim 10 wherein said motor is movably supported above a topographically-varying surface with said drive shaft extending vertically downward and said object is suspended below said shaft.

* * * * *

UNITED STATES PATENT AND TRADEMARK OFFICE

CERTIFICATE OF CORRECTION

PATENT NO. : 4226422

DATED : October 7, 1980

INVENTOR(S) : John A. Belli

It is certified that error appears in the above-identified patent and that said Letters Patent are hereby corrected as shown below:

Claim 9, column 6, line 20, the word "end" should be inserted before the word "of".

Signed and Sealed this

*Twentieth* Day of *January 1981*

[SEAL]

*Attest:*

RENE D. TEGTMEYER

*Attesting Officer*

*Acting Commissioner of Patents and Trademarks*